US006109765A

United States Patent [19]

Blanton

[11] Patent Number: 6,109,765

[45] Date of Patent: Aug. 29, 2000

[54] VARIABLE-POSITION DECORATIVE LIGHT MOUNTING SYSTEM

[76] Inventor: Fred T. Blanton, P.O. Box 8216, The Woodlands, Tex. 77387-8216

[21] Appl. No.: 09/129,166

[22] Filed: Aug. 5, 1998

[51] Int. Cl.[7] ..... F21V 21/14

[52] U.S. Cl. ..... 362/250; 362/396; 248/229.26

[58] Field of Search ..... 362/249, 250, 362/388, 806, 391, 393, 418, 457, 458, 396, 387

[56] References Cited

U.S. PATENT DOCUMENTS

| | | | |
|---|---|---|---|
| 3,584,795 | 6/1971 | Baird | 362/396 |
| 4,888,671 | 12/1989 | Reimer | 362/250 |
| 5,288,047 | 2/1994 | Pan | 248/229.26 |
| 5,544,031 | 8/1996 | Blanton | 362/396 |
| 5,607,230 | 3/1997 | Protz | 362/396 |
| 5,669,709 | 9/1997 | Adams | 362/396 |
| 5,893,628 | 4/1999 | Byers | 362/252 |

*Primary Examiner*—Sandra O'Shea
*Assistant Examiner*—Hargobind S. Sawhney
*Attorney, Agent, or Firm*—Kenneth A. Roddy

[57] ABSTRACT

A variable-position decorative light mounting system for mounting the bulb and socket assemblies of a string of decorative lights at selective positions to achieve decorative effects. A base member provided in elongate strips or shorter rectangular sizes is configured to be secured to a supporting surface and has a flat surface with an outwardly projecting protuberance extending longitudinally along the flat surface with a contiguous reduced neck portion at the juncture of the protuberance with the flat surface. One or more bulb-holding clip members having a bottom portion with a cross sectional shape closely corresponding to the cross sectional shape of the protuberance are removably received and engaged on the protuberance by snap attachment. The bulb-holding clips have a contiguous upper portion with an aperture configured to removably receive and substantially encircle a portion of the bulb and socket assembly to releasably retain it on the clip. One or more wire-holding clip members may also be removably received and engaged on the protuberance by snap attachment to capture a portion of the electrical supply cord between the protuberance and an underside of the clip at selective longitudinally spaced locations such that remaining portions of the electrical supply cord along with a plurality of the decorative bulb and socket assemblies are suspended from the retained portions of the electrical supply cord to achieve decorative ornamental effects.

19 Claims, 5 Drawing Sheets

A
B
S
N
10
11
11A
12
13
14
15
16
17
18
19
20
20A
21

A
B
S
N
11
11A
12
13A
14
15
16
17A
18
19
20
20A
21

A
B
S
11
12
13
14
22
23
24
24A
24B
25
26
27
V
X
13A
22A

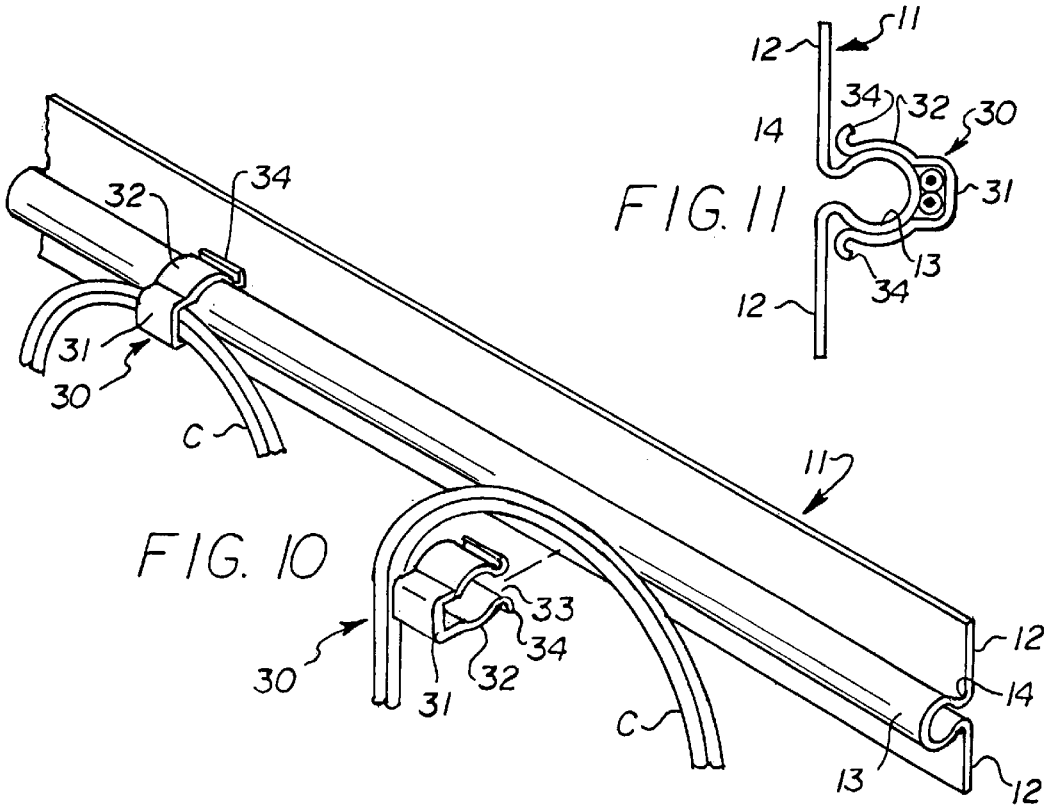
FIG. 11
FIG. 10
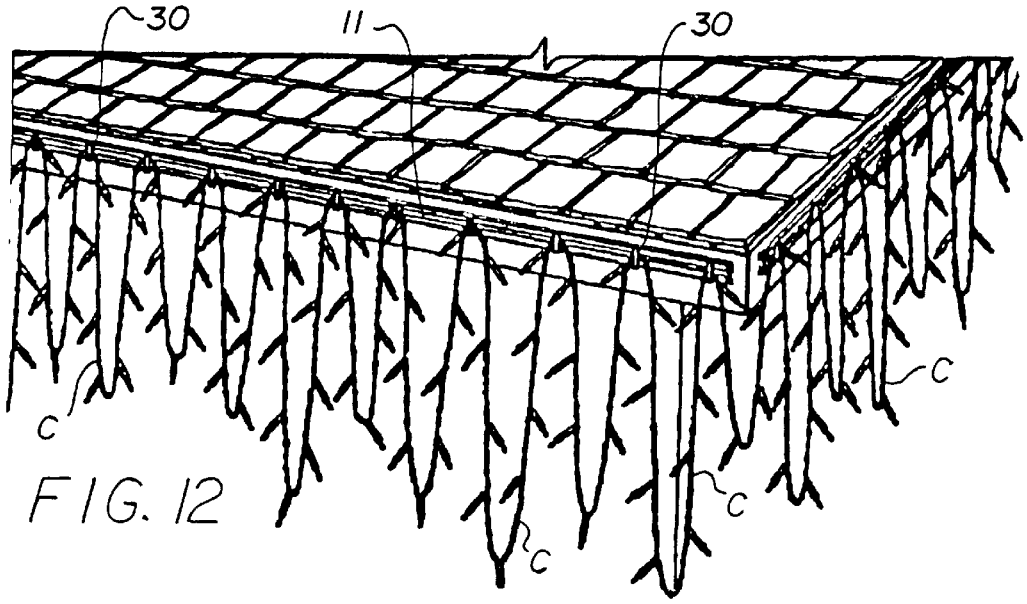
FIG. 12

VARIABLE-POSITION DECORATIVE LIGHT MOUNTING SYSTEM

BACKGROUND OF THE INVENTION

1. Field of the Invention

This invention relates generally to decorative light mounting and support structures, and more particularly to a variable position decorative light mounting system having a base member attachable to a flat surface and removable clip members that snap fit onto the base member and support a string of decorative lights.

2. Brief Description of the Prior Art

It is widely popular during festive seasons, such as Christmas to decorate a residence or commercial building with strings of decorative lights. Conventional decorative lights include a plurality of electrical sockets along the length of an electrical wire which is connected to an electrical power source and light bulbs of various colors are screwed into or pressed into the sockets.

The string of lights are usually installed on a flat surface of the residence or building by stapling the wire along its length to the flat surface and the staples often penetrate the insulated wire or sever the wire. Threaded hooks have also been used to support the string of lights.

There are several patents that disclose unitary brackets which may be used to install decorative lights, most of which require the light bulb to be removed from its socket, inserted through a hole in the bracket, and then to be screwed into its socket to retain the bulb and socket on the bracket, and the reverse operation is required to remove the bulb and socket from the bracket. To adjust the spacing between adjacent brackets, each bracket must be individually positioned and installed. This installation method is time consuming and labor intensive, especially on large commercial buildings.

Some prior art brackets are configured to retain the light bulb and socket assembly in a vertical orientation which is unsatisfactory for outdoor installations because water and moisture may run down the neck of the light bulb and enter the socket through the threads of the light bulb base and socket connection which can cause corrosion or an electrical short.

Comito, U.S. Pat. No. 4,795,121 discloses a window frame light hanger device comprising an "L" shaped elongate strip having a first and second leg portion normal to each other with a series of longitudinally spaced tapered keyhole shaped openings formed in both leg portions to receive a light socket, and a series of longitudinally spaced nail holes formed in the L-shaped strip in alternating relation to the keyhole shaped openings and on the same longitudinal axis. This device would not be suitable for use in installing a large number of lights in spaced apart relation.

Gary, U.S. Pat. No. 4,851,977 discloses an L-shaped decorative light support device adapted to be inserted between the decking and shingles of a building roof and maintained therebetween solely by frictional contact. The device has an elongate flat horizontal leg and a vertical leg. The horizontal leg may be provided with transverse undulations to increase the frictional engagement between the overlapped layers of the roof structure, or may have a inwardly converging V-shaped notch which allows the horizontal leg to be inserted between the layers around a fastening device such as a roofing nail that holds the shingles. The vertical leg may have a single complete circular hole therethrough or a pair of vertically adjoined holes of different diameter. The diameter of the holes in the vertical leg is large enough to receive the base portion of a decorative light bulb therethrough before the light bulb is connected to its socket and small enough to prevent the connected light bulb and socket from passing therethrough. In other words, the bulb must be removed from its socket, inserted through the hole and then screwed into its socket, and the reverse operation is required to remove the bulb and socket from the device.

Gary, U.S. Pat. No. 4,905,131 discloses an L-shaped decorative light support device adapted to be inserted between the decking and shingles of a building roof and maintained therebetween solely by frictional contact. The device has and elongate horizontal leg and a vertical leg. The horizontal leg may have an inwardly converging V-shaped notch which allows the horizontal leg to be inserted between the layers around a fastening device such as a roofing nail that holds the shingles. The horizontal leg has a tab or tabs at the outer end which fold back over the horizontal portion at an acute angle to increase the frictional engagement between the overlapped layers of the roof structure. The vertical leg may have a single complete circular hole therethrough or a pair of vertically adjoined holes of different diameter wherein the diameter of the holes in the vertical leg is large enough to receive the base portion of a decorative light bulb therethrough before the light bulb is connected to its socket and small enough to prevent the connected light bulb and socket from passing therethrough. In other words, the bulb must be removed from its socket, inserted through the hole and then screwed into its socket, and the reverse operation is required to remove the bulb and socket from the device. Alternatively, the hole is surrounded by a tubular tapered collar to receive and frictionally engage a socket inserted from the rear of the collar.

Gary, U.S. Pat. No. 5,249,108 discloses a decorative light holder adapted to be inserted between the decking and shingles of a building roof and maintained therebetween solely by frictional contact. The holder has and elongate horizontal leg with a tab at the outer end which folds back over the horizontal portion at an acute angle to increase the frictional engagement between the overlapped layers of the roof structure. The holder has a short vertical portion perpendicular to the horizontal leg and an extension perpendicular to the short vertical portion. The extension has a pair of adjoining holes of different diameter with an opening extending from the outermost hole to the exterior. An integral hinge between the short vertical portion allows the extension to be parallel to the horizontal leg in a generally Z-shaped configuration for vertical bulb and socket installations, or to be folded to be parallel with the short vertical portion in an L-shaped configuration for horizontal bulb and socket installations.

Prickett, U.S. Pat. No. 4,974,128 discloses a two-piece rapidly adjustable decorative exterior trim lighting system having an elongated extruded plastic retaining strip in a laterally folded configuration secured by adhesive to a flat surface and a series of straight or L-shaped light support tabs which are insertable and frictionally retained between the folded side portions of the retaining strip at adjustable longitudinally spaced intervals along the strip. The outer ends of the light support tabs vertical leg have circular hole therethrough which requires that the bulb be removed from its socket, inserted through the hole and then screwed into its socket, and the reverse operation is required to remove the bulb and socket from each tab.

Prickett, U.S. Pat. No. 5,067,061 discloses a decorative exterior trim lighting system having an elongated extruded plastic retaining strip in a laterally folded configuration secured by adhesive to a flat surface and having a plurality of longitudinally spaced holes formed through the strip which receive the bulb sockets of a string of lights and maintain them in a vertical position. The spacing of the holes and thus the relative position of adjacent lights are fixed. A series of L-shaped light support tabs may also be inserted and frictionally retained between the folded side portions of the retaining strip at adjustable longitudinally spaced intervals along the strip.

Liou, U.S. Pat. No. 5,526,246 discloses a unitary positioning structure for a pattern of a decorative lamp string having an elongated rectangular strip forming a pattern frame with a series of longitudinally spaced integrally molded inwardly curved generally U-shaped fastener jaw elements which receive the bulb sockets of a string of lights and maintain them in a position parallel to the rectangular strip. The spacing of the fastener jaw elements and thus the position of adjacent lights are fixed.

Wu, U.S. Pat. No. 5,664,877 discloses a two-piece positioning structure for a decorative lamp string having an elongated thin rectangular strip with a series of longitudinally spaced recesses along lateral sides and a series of inwardly curved generally U-shaped clamping elements which are fitted onto the strip in the recesses to receive the bulb sockets of a string of lights and maintain them in a position parallel to the rectangular strip. The spacing of the recesses and the clamping elements and thus the position of adjacent lights are fixed.

Byers, U.S. Pat. No. 5,513,081 discloses an installation and storage system for decorative light strings which includes a plurality of generally U-shaped track channels for holding successive segments of the light string. The channels have an inverted U-shaped channel along the bottom surface which is received by snap attachment to pre-positioned snap fasteners secured to a flat surface. The track channels require a special light bulb socket or adapter that extends radially from the bottom of the bulb socket to slidably and frictionally engage the lateral sides of the U-shaped channel. Alternatively, standard decorative light bulb sockets may be retained on a channel having a longitudinal U-shaped track center portion with integral I-shaped lateral sides. Successive segments of the light string are received in the U-shaped center portion and inverted wide U-shaped clip elements snapped over the U-shaped channel at longitudinally spaced sides of the bulb socket to hold the bulb in a vertical position and retain the light string in the U-shaped center portion. In still another embodiment, miniature light strings may be retained on a channel having a longitudinal U-shaped track center portion with integral I-shaped lateral sides. Successive segments of the light string are received in the U-shaped center portion and inverted wide U-shaped clip elements having an upstanding semi-circular portion which holds the miniature bulb in a vertical position are snapped over the U-shaped channel.

Byers, U.S. Pat. No. 5,707,136 discloses a multiple light system for decorative light strings which includes an inverted wide U-shaped track channel with integral I-shaped lateral sides and may also have a U-shaped center channel. The track channels are snap attached to pre-positioned snap fasteners secured to a flat surface. Standard decorative light bulb sockets may be retained on the track channel with successive segments of the light string received on the flat top of the channel or in the U-shaped center portion and inverted wide U-shaped clip elements are snapped over the track channel at longitudinally spaced sides of the bulb socket to hold the bulb in a vertical position and retain the light string along the length of the track channel. In another embodiment, the bulb sockets may be retained on a track channel by wide inverted U-shaped clip elements having a horizontal semi-circular portion which holds the bulb socket in a horizontal position that are snapped over the track channel.

Pan, U.S. Pat. No. 5,288,047 discloses a generally figure-eight shaped clip for connecting decorative light strings to a wire frame wherein the clip has a first semi-circular portion with an opening adapted to releasably and grippingly receive a base of a light bulb and a second semi-circular portion with a second opening adapted to releasably and grippingly receive a frame member, wherein the first and second openings are in linearly aligned relation within opposing ends of the clip.

U.S. Pat. Nos. 4,837,899, 4,407,472, 4,292,749, and 4,244,542 also disclose generally figure-eight shaped clips for connecting various objects wherein the clip has a first and second semi-circular portion with a respective first and second opening in the semi-circular portions, wherein the first and second openings are in linearly aligned relation within opposing ends of the clip.

The present invention is distinguished over the prior art in general, and these patents in particular by a variable-position decorative light mounting system wherein the bulb and socket assemblies of a string of decorative lights may be easily and quickly mounted at selective positions to achieve decorative effects. A base member provided in elongate strips or shorter rectangular sizes is configured to be secured to a supporting surface and has a flat surface with an outwardly projecting protuberance extending longitudinally along the flat surface with a contiguous reduced neck portion at the juncture of the protuberance with the flat surface. One or more bulb-holding clip members having a bottom portion with a cross sectional shape closely corresponding to the cross sectional shape of the protuberance are removably received and engaged on the protuberance by snap attachment. The bulb-holding clips have a contiguous upper portion with an aperture configured to removably receive and substantially encircle a portion of the bulb and socket assembly to releasably retain it on the clip. One or more wire-holding clip members may also be removably received and engaged on the protuberance by snap attachment to capture a portion of the electrical supply cord between the protuberance and an underside of the clip at selective longitudinally spaced locations such that remaining portions of the electrical supply cord along with a plurality of the decorative bulb and socket assemblies are suspended from the retained portions of the electrical supply cord to achieve decorative ornamental effects.

SUMMARY OF THE INVENTION

It is therefore an object of the present invention to provide a variable-position decorative light mounting system wherein the bulb and socket assemblies of a string of decorative lights may be easily and quickly mounted at selective positions to achieve various decorative effects.

It is another object of this invention to provide a variable-position decorative light mounting system having a base member provided in elongate strips or shorter rectangular sizes which is easily and quickly secured to a supporting surface and has an outwardly projecting protuberance onto which bulb-holding clips and/or wire-holding clips may be removably attached.

Another object of this invention is to provide a variable-position decorative light mounting system wherein bulb-holding clips and/or wire-holding clips may be easily and quickly installed at various selective locations on a base member by snap attachment, and are easily and quickly removed therefrom.

Another object of this invention is to provide a variable-position decorative light mounting system having a base member provided in elongate strips or shorter rectangular sizes which may be left in place year-round.

Another object of this invention is to provide a variable-position decorative light mounting system having bulb-holding clips wherein the bulb and socket assembly is installed and removed as a unit and does not require time and labor intensive removal of the bulb from the socket for installation or removal.

Another object of this invention is to provide a variable-position decorative light mounting system wherein wire-holding clips may be easily and quickly installed at various selective locations to secure the electrical cord to a base member by snap attachment, and remaining portions of the electrical cord with a plurality of the decorative bulb and socket assemblies may be suspended to achieve various ornamental draped and icicle style decorative effects.

A further object of this invention is to provide a variable-position decorative light mounting system which can be installed on flat surfaces of a building, on roofs, or on rain gutters.

A still further object of this invention is to provide a variable-position decorative light mounting system which is inexpensive to manufacture, long-lasting, and weather resistant.

Other objects of the invention will become apparent from time to time throughout the specification and claims as hereinafter related.

The above noted objects and other objects of the invention are accomplished by a variable-position decorative light mounting system wherein the bulb and socket assemblies of a string of decorative lights may be easily and quickly mounted at selective positions to achieve decorative effects. A base member provided in elongate strips or shorter rectangular sizes is configured to be secured to a supporting surface and has a flat surface with an outwardly projecting protuberance extending longitudinally along the flat surface with a contiguous reduced neck portion at the juncture of the protuberance with the flat surface. One or more bulb-holding clip members having a bottom portion with a cross sectional shape closely corresponding to the cross sectional shape of the protuberance are removably received and engaged on the protuberance by snap attachment. The bulb-holding clips have a contiguous upper portion with an aperture configured to removably receive and substantially encircle a portion of the bulb and socket assembly to releasably retain it on the clip. One or more wire-holding clip members may also be removably received and engaged on the protuberance by snap attachment to capture a portion of the electrical supply cord between the protuberance and an underside of the clip at selective longitudinally spaced locations such that remaining portions of the electrical supply cord along with a plurality of the decorative bulb and socket assemblies are suspended from the retained portions of the electrical supply cord to achieve decorative ornamental effects.

BRIEF DESCRIPTION OF THE DRAWINGS

FIG. 10 is a perspective view of a variable-position decorative light mounting system having an elongate base strip with a bulbous protusion and mating wire-holding clip members in accordance with the present invention.

FIG. 11 is a side elevation showing a wire-holding clip member to the base strip.

FIG. 12 is a perspective view of roof of a house showing strings of decorative lights suspended by the wire-holding clip members arranged to give a decorative icicle effect.

DESCRIPTION OF THE PREFERRED EMBODIMENT

Figures 1, 2, 3:
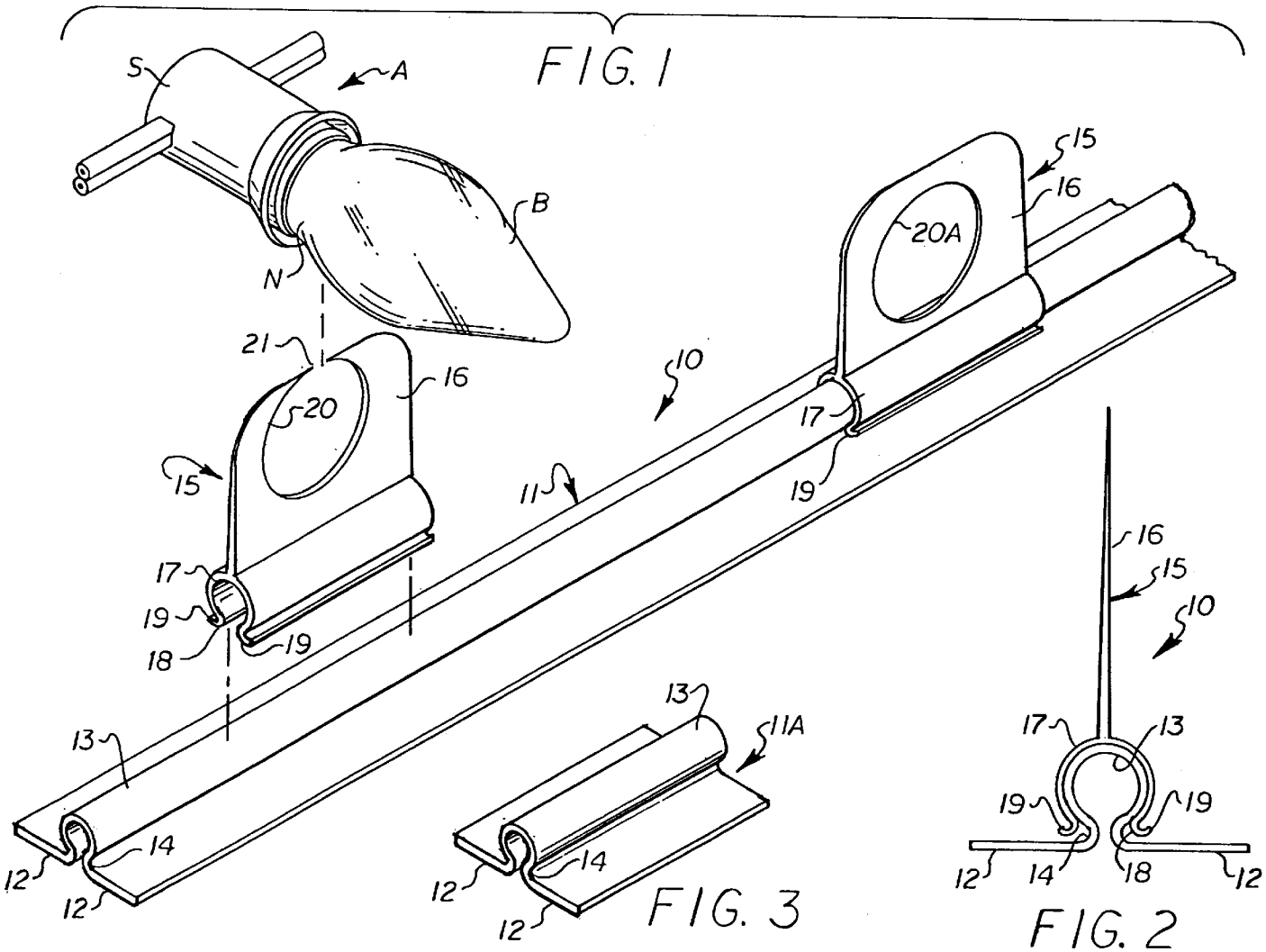
FIG. 1 is a perspective view of a variable-position decorative light mounting system having a base member in the form of an elongate strip with a bulbous protuberance and mating clip members in accordance with the present invention.
FIG. 2 is a side elevation of a clip member attached to the base strip.
FIG. 3 is a perspective view of a shorter rectangular base member embodiment.

Referring to the drawings by numerals of reference, there is shown in FIG. 1, a variable position decorative light mounting system 10 for supporting a string of decorative lights on a flat surface. The system 10 includes a base member 11 having flat lateral side portions 12 and a central longitudinally extending raised protuberance 13 with a contiguous reduced neck portion 14 at the juncture of the protuberance and side portions. In the embodiment of FIG. 1, the base member 11 is an elongate strip with a protuberance having a generally rounded bulbous cross section. In the preferred embodiment, the base member 11 is made of a suitable weather resistant plastic material and formed by an extrusion process.

The width of the flat lateral side portions 12 are of sufficient width to receive the head of a staple gun for installing staples at spaced distances along the length of the base member 11 to secure the base member to a generally flat surface. It should be understood that the base member may also be secured to a generally flat surface by other conventional fastener means, such as driving nails or screws through the lateral side portions, applying an adhesive on the underside of the lateral side portions, or applying a double-sided adhesive tape to the underside of the lateral side portions.

A series of integrally molded light clip elements 15 are removably engaged on the bulbous protuberance 13 by snap attachment. The light clips 15 have a generally flat rectangular upper portion 16 and a contiguous semi-circular bottom portion 17. The semi-circular bottom portion 17 has a downward facing opening 18 smaller in width than the width of the protuberance 13, so as to snap fit onto and grippingly engage the protuberance when pressed downwardly thereon. The lateral sides of the opening of the semi-circular bottom portion may be provided with a small recurved or outwardly and upwardly rounded portion 19 to facilitate pressing the clip 15 onto the protuberance 13. Depending upon the longitudinal length of the semi-circular bottom portion 17, installation on the protuberance may be facilitated by placing one end of the opening on the protuberance and pressing the clip downward in a rocking motion until the bottom portion snaps onto the protuberance.

The upper portion 16 of each clip 15 has an aperture near its outer end defined by a circular hole 20 of sufficient diameter to substantially encircle the neck portion N of a decorative light bulb B and an adjoining narrow opening 21 extending outwardly from the circular hole to the exterior of the vertical upper portion. The decorative light bulb and socket assembly "A" is installed in the clip 15 as a single unit without disassembly of the bulb B and socket S by pressing the neck portion N of the light bulb adjacent its socket downwardly and twisting the bulb assembly such that the neck portion N passes through the narrow opening 21 into the circular hole 20 to become substantially encircled by the hole, and is removed therefrom as a single unit by pulling the bulb and socket assembly upwardly and twisting it such that the neck portion of the bulb passes outwardly through the narrow opening. As the bulb and socket assembly is twisted, the opposed top edges of the opening spread apart due to the resiliency of the clip material to allow the neck portion N of the bulb to pass through the narrow opening 21 and then resume their normal laterally aligned condition.

As shown in FIG. 2, the upper portion 16 of the clip 15 preferably has a tapered vertical cross section of diminishing thickness in the vertical direction to increase flexibility of the upper portion at its outwardly extended end and reduce the force required to press or pull, and twist the neck portion N of the light bulb B through the narrow opening 15 during installation and removal.

Alternatively, as seen in FIG. 1, the upper portion 16 of the clip 15 may be provided with a generally centered hole 20A and no narrow opening. This modification requires that the bulb B be removed from its socket S, inserted through the hole 20A and then screwed back in to its socket, and the reverse operation is required to remove the bulb and socket from each clip. However, once assembled, the clips 15 may be left on the assembled bulb and socket and stored that way, and then the bulb, socket, and clip, as a unit, can be easily and quickly attached to the base member when their use is desired.

The base member 11 may be provided in various lengths, for example, in 3 foot, 5 foot, and 6 foot lengths. Alternatively, as shown in FIG. 3, the base member may be provided as short segments 11A, for example a length of about 1½" to 2". A series of the shorter base members 11A may be secured to a flat surface in longitudinally spaced relation, or may be spaced in various other patterns to achieve a decorative effect when the mating clips and light bulb an socket assemblies are installed thereon.

Figures 4, 5, 6:
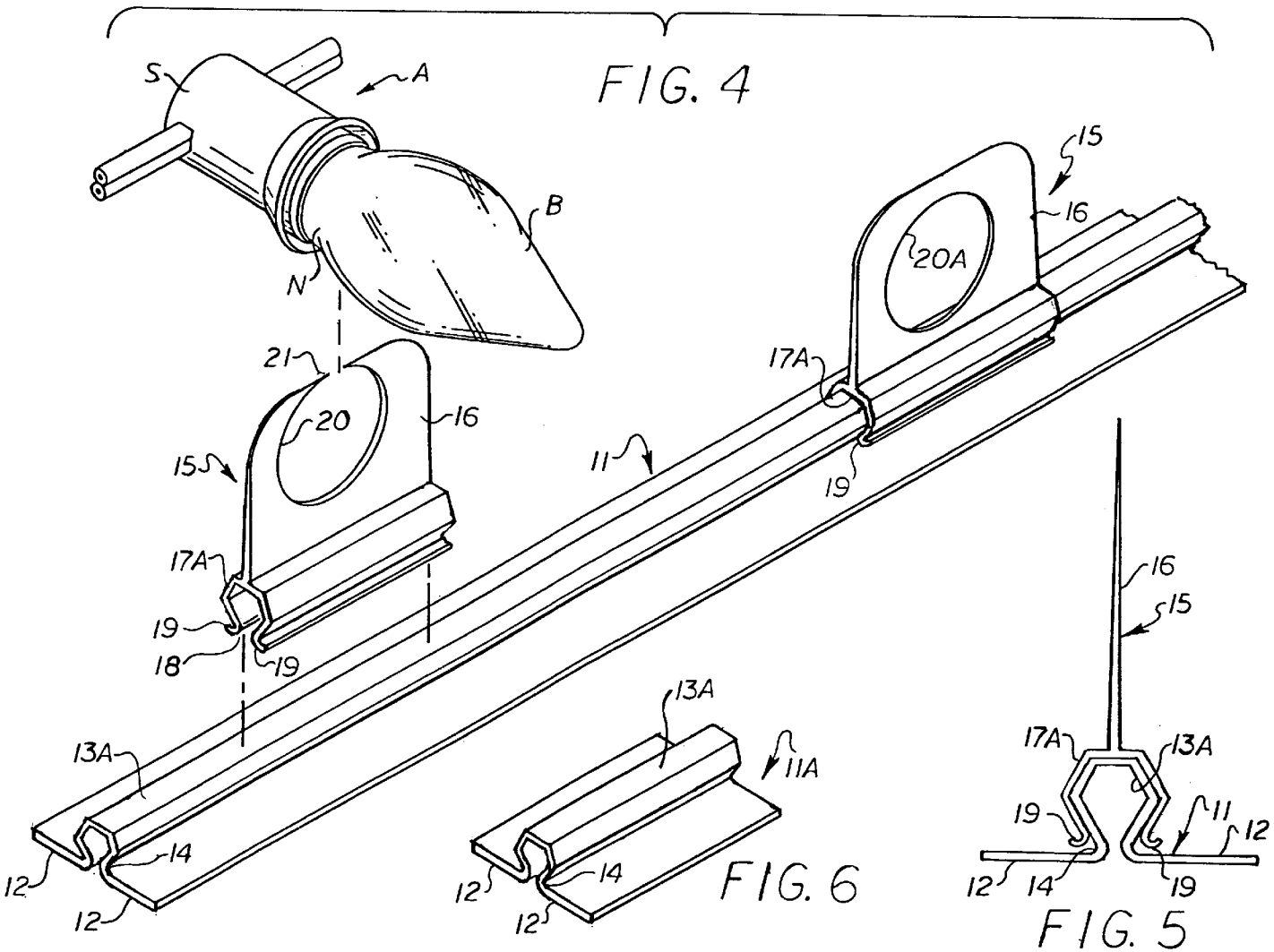
FIG. 4 is a perspective view of a variable-position decorative light mounting system having an elongate base strip with a polygonal protuberance and mating clip members in accordance with the present invention.
FIG. 5 is a side elevation of a clip member attached to the base strip having a polygonal protuberance.
FIG. 6 is a perspective view of a shorter rectangular base member embodiment having a polygonal protuberance.

Alternatively, as shown in FIGS. 4, 5, and 6, the base member 11 may be formed with a raised longitudinally extending polygonal protuberance 13A and flat lateral side portions 12 with a contiguous reduced neck portion 14 at the juncture of the protuberance and side portions. The integrally molded light clip elements 15 in this modification are provided with a bottom portion 17A which is polygonal in cross section and has a downward facing opening 18 smaller in width than the maximum width of the polygonal protuberance 13A, so as to snap fit onto and grippingly engage the protuberance when pressed downwardly thereon. The lateral sides of the opening of the polygonal bottom portion may be provided with a small recurved or outwardly and upwardly rounded portion 19 to facilitate pressing the clip 15 onto the protuberance 13A. The the light clips with the polygonal bottom portion have a generally flat rectangular upper portion 16 and a circular hole 20 with a narrow opening 21 extending outwardly therefrom, or a central hole 20A, as described previously.

Figures 7, 8, 9:
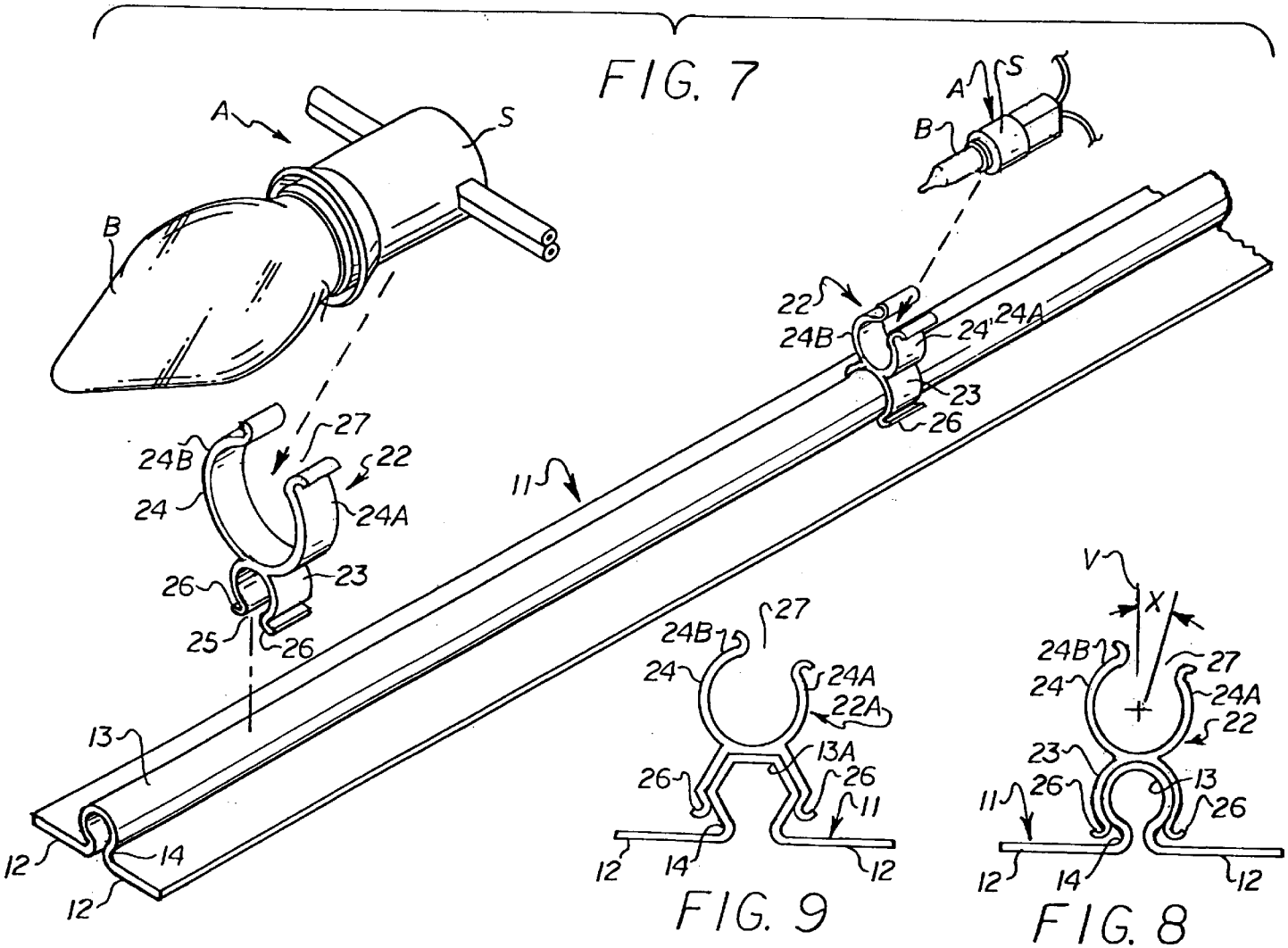
FIG. 7 is a perspective view of a variable-position decorative light mounting system having an elongate base strip with a bulbous protusion and mating clip members having a semicircular upper portion in accordance with the present invention.
FIG. 8 is a side elevation of a clip member having a semi-circular upper portion attached to the base strip having a bulbous protuberance.
FIG. 9 is a side elevation of a clip member having a semi-circular upper portion and a polygonal bottom portion a base strip having a polygonal protuberance.

FIGS. 7 and 8 show an alternate clip configuration 22 which may be used to attach a string of decorative lights to the base member 11 wherein the bulb and socket assembly is positioned parallel to the raised protuberance 13. In this embodiment, the clip 22 has a semi-circular lower portion 23 and a contiguous semi-circular upper portion 24 forming a generally figure-eight configuration. The semi-circular lower portion 23 has a downward facing opening 25 smaller in width than the width of the protuberance 13, so as to snap fit onto and grippingly engage the protuberance when pressed downwardly thereon. The lateral sides of the opening of the semi-circular bottom portion may be provided with a small recurved or outwardly and upwardly rounded portion 26 to facilitate pressing the clip 22 onto the protuberance 13.

The semi-circular upper portion 24 of the clip 22 has an opening 17 smaller in width than the diameter of the bulb socket S, so as to snap fit onto and grippingly engage the socket when it is pressed through the opening. It should be noted that, unlike figure-eight clip configurations of the prior art, the openings 25 and 27 are not linearly aligned. Instead, the opening 25 in the semi-circular lower portion is centered along a vertical axis "V" and the opening 27 in the upper portion is offset by an angle "X" relative to the vertical axis. The angular offset "X" may range from about 15° to about 90°. Thus, the openings 25 and 27 are not linearly aligned, but are angularly offset.

It has been found that offsetting the opening 27 in the upper portion 24 allows the bulb socket S to be installed easier and provides improved gripping strength than conventional figure-eight clips having opposed legs of equal length. This is due to the unequal flexing of the curved legs of the semicircular portion 24 and location of the opening 27. In other words, the shorter curved leg 24A is relatively stiff and will expand less in relation to the longer curved leg 24B which is more flexible and will expand more due to its length. Thus, less force is required to snap the bulb socket into the upper portion, and also to remove it. The longer leg overlaps the longitudinal axis of the socket and the opening is positioned to one side of the socket and offset relative to the protuberance. Thus, the socket is less likely to become accidentally disengaged from the clip.

FIG. 9 shows an modification 22A of the clip 22 which has a semi-circular upper portion, as just described, but with a contiguous polygonal lower portion 23A for use with a base member 11 or 11A having a polygonal protuberance 13A, also described previously. The polygonal lower portion 23A has a downward facing opening smaller in width than the width of the polygonal protuberance 13A, so as to snap fit onto and grippingly engage the protuberance when pressed downwardly thereon. The lateral sides of the opening may be provided with a small recurved or outwardly and upwardly rounded portion 26 to facilitate pressing the clip 22A onto the protuberance 13A.

FIGS. 10 and 11 show a wire-holding clip 30 which is used to attach the electrical wires or cord "C" of the light string to the base member 11, wherein the bulb and socket assemblies "A" of the light string hang downwardly from the base member to create a decorative effect. In this embodiment, the clip 30 has a narrow inverted U-shaped upper portion 31 and a wider contiguous semi-circular lower portion 32 forming a generally horseshoe-shaped configuration. The semi-circular lower portion 32 has a downward facing opening 33 smaller in width than the width of the protuberance 13, so as to snap fit onto and grippingly engage the protuberance when pressed downwardly thereon. The lateral sides of the opening of the semi-circular bottom portion may be provided with a small recurved or outwardly rounded portion 34 to facilitate pressing the clip 30 onto the protuberance 13. The inverted U-shaped upper portion 31 is smaller in width than the width of the protuberance 13 so as to overlap a section of the electrical wires or cord "C" of the light string and capture it against the protuberance.

As best seen in FIG. 12, a series of the clips 30 may be attached at various longitudinally spaced distances along the base member 11 to hold a section of the electrical wires of the light string against the protuberance and llow the portion of the light string between adjacent clips to hang downwardly from the base member. When the clips 30 are placed relatively close together, the bulbs in the downwardly hanging portion of the light string give the appearance of icicles. When the clips are placed relatively far apart, the bulbs in the downwardly hanging portion of the light string give a decorative acruate loop or draped appearance.

It should be understood that the clips 30 that hold the electrical wires may also be used in combination with the previously described clips that hold the bulb and socket assemblies to create a variety of decorative effects, and to neatly secure sections of the electrical wires to the base member where desired.

After the base member has been secured to the flat surface, it may be left in place all year long. It may also be painted to match the surface to which it is attached. The decorative light strings are easily and quickly removed by simply unsnapping them from the base member. The decorative light strings may be stored with the clips still attached to the bulb and socket assemblies, or they may be removed therefrom as desired.

Figure 14:
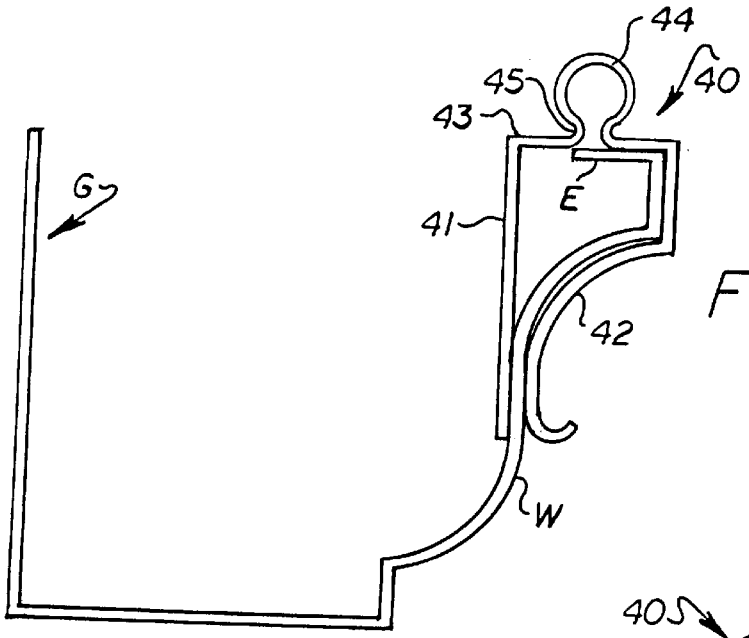
FIG. 14 is a side elevation of the base member of FIG. 13 shown attached to a rain gutter.
Figure 13:
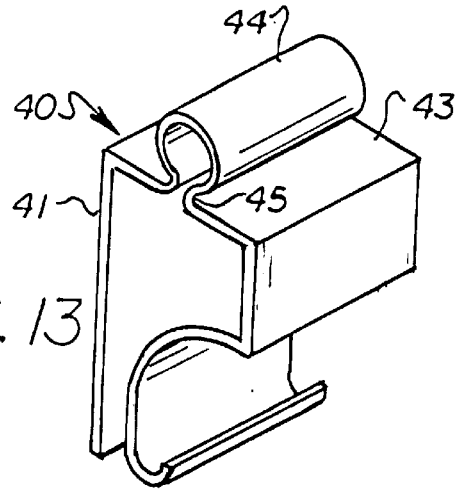
FIG. 13 is a perspective view of a base member with a bulbous protusion that may be attached to rain gutters and into the shingles of a roof.
Figure 15:
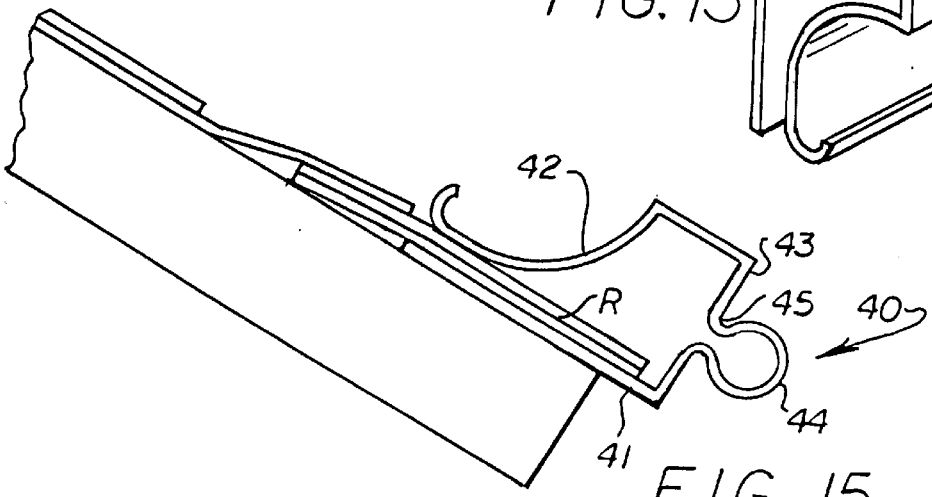
FIG. 15 is a side elevation of the base member of FIG. 13 shown attached to a shingle on a roof.

As shown in FIGS. 13, 14, and 15, the previously described wire-holding clips and bulb and socket holding clips may also be used to attach decorative light strings to conventional rain gutters and shingles of roofs. In this modification, a base member 40 is provided which has a flat leg portion 41 and an opposed curved leg portion 42 with a flat surface 43 therebetween. The flat surface 43, and opposed leg portions 41 and 42 are sized and shaped to closely correspond to the cross sectional shape of the top edge "E" and outer wall "W" of a conventional rain gutter "G" so as to be removably received and grippingly engaged thereon. An outwardly projecting protuberance 44 extends longitudinally along the outer face of the flat surface 43 and has a contiguous reduced neck portion 45 at the juncture of the protuberance with the flat surface.

As shown in FIG. 15, the previously described base member 40 may also be installed on the singles of a roof. In this installation, the flat leg portion 41 is inserted beneath the underside of a roofing shingle "R" with the opposed curved leg portion 42 gripping the top surface of the shingle and the flat surface 43 and protuberance 44 facing outwardly.

Although a bulbous protuberance is shown in the illustrated examples of FIGS. 13, 14, and 15, it should be understood that the protuberance 44 may alternatively have a polygonal cross section, as shown and described previously. Any of the previously described and shown clip member embodiments having a bottom portion with a downward facing opening and a cross sectional shape closely corresponding to the cross sectional shape of the protuberance may be removably received and grippingly engaged on the protuberance by snap attachment. To avoid repetition, the details of the respective clips are not shown in FIGS. 13, 14, and 15, and their detailed description is not be repeated here since they have been shown previously and described at length above.

While this invention has been described fully and completely with special emphasis upon a preferred embodiment, it should be understood that within the scope of the appended claims the invention may be practiced otherwise than as specifically described herein.

What is claimed is:

1. A variable-position decorative light mounting system for mounting a decorative light bulb and socket assembly electrically connected to an electrical supply cord, comprising:

a base member adapted to be secured to a supporting surface and having a flat surface with an outwardly projecting protuberance extending longitudinally along said flat surface and a contiguous reduced neck portion at the juncture of said protuberance with said flat surface;

at least one resilient bulb-holding clip member having a bottom portion with a downward facing opening and having a cross sectional shape closely corresponding to the cross sectional shape of said protuberance so as to be removably received and grippingly engaged on said protuberance by snap attachment, and a contiguous generally semi-circular upper portion extending upwardly from said bottom portion; and a circular aperture in said upper portion of sufficient diameter to removably receive and substantially encircle the socket of said decorative light bulb and socket assembly with a narrow adjoining opening extending from said circular aperture to the exterior of said upper portion;

said narrow opening in said upper portion angularly offset from said downward facing opening in said bottom portion with respect to a linear vertical axis such that said semi-circular upper portion has a relatively stiff shorter curved leg portion and a more flexible longer curved leg portion due to its length; whereby a decorative light bulb and socket assembly is installed in said bulb-holding clip member as a single unit without disassembly of the bulb and socket by pressing the socket of the bulb and socket assembly downwardly such that the socket passes through said narrow opening in said upper portion to be removably received and grippingly engaged in said circular aperture by snap attachment and said bulb and socket is supported in a generally horizontal position perpendicular to said clip member; and said bulb and socket assembly is removed from said bulb-holding clip member as a single unit by pulling the bulb and socket assembly upwardly such that the socket passes outwardly through said narrow opening in said upper portion.

2. The decorative light mounting system according to claim 1, wherein said base member is a generally rectangular strip of material with said outwardly projecting protuberance extending longitudinally along one face of said flat surface.

3. The decorative light mounting system according to claim 1, wherein said base member is an elongate generally rectangular strip of material with said outwardly projecting protuberance extending longitudinally along one face of said flat surface.

4. The decorative light mounting system according to claim 1, wherein said outwardly projecting protuberance extends longitudinally along the center of one face of said flat surface defining flat side portions of said flat surface on laterally opposed sides of said protuberance.

5. The decorative light mounting system according to claim 1, wherein said base member has a flat leg portion extending generally perpendicular to said flat surface along one side thereof and a curved leg portion extending along an opposed side of said flat surface in opposed facing relation to said flat leg portion;

said opposed facing leg portions sized and shaped to selectively receive and grippingly engage either of a roofing shingle and an upper outer surface of a rain gutter, with said protuberance facing outwardly therefrom.

6. The decorative light mounting system according to claim 1, wherein said downward facing opening of said bulb-holding clip member bottom portion has laterally opposed sides with small outwardly curved portions at a bottom end thereof to facilitate attachment and removal of said bulb-holding clip member bottom portion onto and off of said protuberance.

7. The decorative light mounting system according to claim 1, wherein said protuberance has a generally rounded bulbous cross section; and said bulb-holding clip member bottom portion has a mating semi-circular cross section corresponding to said generally rounded bulbous cross section sized to be received thereon and said downward facing opening is sufficiently smaller in width than the width of said protuberance.

8. The decorative light mounting system according to claim 1, wherein said protuberance has a generally polygonal cross section; and said bulb-holding clip member bottom portion has a mating generally polygonal cross section corresponding to said polygonal cross section sized to be received thereon and said downward facing opening sufficiently smaller in width than the width of said protuberance to facilitate gripping engagement with said protuberance by snap attachment.

9. The decorative light mounting system according to claim 1, wherein said narrow opening in said upper portion has laterally opposed sides with small outwardly curved portions at an outer end thereof to facilitate attachment and removal of the socket into and out of said circular aperture.

10. The decorative light mounting system according to claim 1, further comprising:

at least one resilient wire-holding clip member having a bottom portion with a downward facing opening and having a cross sectional shape closely corresponding to the cross sectional shape of said protuberance so as to be removably received and grippingly engaged on said protuberance by snap attachment, and a contiguous upper portion extending upwardly from said bottom portion; and said wire-holding clip member upper portion sized and shaped to removably receive and capture a portion of the electrical supply cord between an exterior surface of said protuberance and an underside surface of said upper portion.

11. The decorative light mounting system according to claim 10, wherein said downward facing opening of said wire-holding clip member bottom portion has laterally opposed sides with small outwardly curved portions at a bottom end thereof to facilitate attachment and removal of said clip bottom portion onto and off of said protuberance.

12. The decorative light mounting system according to claim 10, wherein said protuberance has a generally rounded bulbous cross section;

said wire-holding clip member bottom portion has a mating semi-circular cross section corresponding to said generally rounded bulbous cross section sized to be received thereon and said downward facing opening is sufficiently smaller in width than the width of said protuberance to facilitate gripping engagement with said protuberance by snap attachment; and said wire-holding clip member upper portion is an inverted generally U-shaped configuration smaller in width than the width of said protuberance.

13. The decorative light mounting system according to claim 10, wherein said protuberance has a generally polygonal cross section;

said wire-holding clip member bottom portion has a mating generally polygonal cross section corresponding to said polygonal cross section sized to be received thereon and said downward facing opening sufficiently smaller in width than the width of said protuberance to facilitate gripping engagement with said protuberance by snap attachment; and said wire-holding clip member upper portion is an inverted generally U-shaped configuration smaller in width than the width of said protuberance.

14. A variable position decorative light mounting system for mounting a decorative light bulb and socket assembly electrically connected to an electrical supply cord, comprising in combination:

a base member adapted to be secured to a supporting surface and having a flat surface with an outwardly projecting protuberance extending longitudinally along said flat surface and a contiguous reduced neck portion at the juncture of said protuberance with said flat surface; and at least one resilient bulb-holding clip member having a bottom portion with a downward facing opening and a cross sectional shape closely corresponding to the cross sectional shape of said protuberance so as to removably receive and grippingly engage said protuberance by snap attachment, and a contiguous generally flat rectangular upper portion extending upwardly from said bottom portion with a circular hole disposed near an outer edge thereof of sufficient diameter to substantially encircle the neck portion of a decorative light bulb with a narrow adjoining opening extending outwardly from said hole to the exterior of said outer edge; whereby a decorative light bulb and socket assembly is installed in said bulb-holding clip member as a single unit without disassembly of the bulb and socket by pressing the neck portion of the light bulb adjacent its socket downwardly and twisting the bulb assembly such that the neck portion passes through said narrow opening into said hole to become substantially encircled by said hole and said bulb and socket is supported in a generally horizontal position perpendicular said flat rectangular upper portion; and said bulb and socket assembly is removed from said bulb-holding clip member as a single unit by pulling the bulb and socket assembly upwardly and twisting it such that the neck portion of the bulb passes outwardly through said narrow opening.

15. The decorative light mounting system according to claim 14, wherein said bulb-holding clip member upper portion is a vertical generally flat rectangular configuration having a tapered vertical cross section of diminishing thickness in the vertical direction to increase flexibility of said upper portion at its said outer edge and reduce the force required to press or pull, and twist the neck portion of the light bulb through said narrow opening during installation and removal.

16. A variable-position decorative light mounting system for mounting a decorative light bulb and socket assembly electrically connected to an electrical supply cord, comprising:

a base member adapted to be secured to a support surface and having a flat surface with an outwardly projecting protuberance extending longitudinally along said flat surface and a contiguous reduced neck portion at the juncture of said protuberance with said flat surface;

a plurality of resilient wire-holding clip members each having a bottom portion with a downward facing opening and having a cross sectional shape closely corresponding to the cross sectional shape of said protuberance so as to be removably received and grippingly engaged on said protuberance by snap attachment, and a contiguous upper portion extending upwardly from said bottom portion; and said wire-holding clip upper portion sized and shaped to removably receive and capture a portion of the electrical supply cord between an exterior surface of said protuberance and an underside surface of said upper portion; whereby selective longitudinally spaced portions of the electrical supply cord are releasably retained on said base member by said wire-holding clip members and remaining portions of the electrical supply cord between adjacent wire-holding clips along with a plurality of the decorative light bulb and socket assemblies are suspended from the retained portions of the electrical supply cord to achieve decorative ornamental effects.

17. A clip member for use in a decorative light mounting system for mounting a decorative light bulb and socket assembly, comprising:

a resilient bulb-holding clip member having a semicircular bottom portion sized and shaped to receive and engage a rounded bulbous protuberance by snap attachment, and a contiguous opposed semi-circular upper portion sized and shaped to receive and engage a socket of a decorative light bulb and socket assembly by snap attachment;

a downward facing opening in said semi-circular bottom portion smaller in width than the width of the protuberance; and an opening in said semi-circular upper portion smaller in width than the socket and angularly offset from said downward facing opening with respect to a linear vertical axis to define a relatively stiff shorter curved leg portion and a more flexible longer curved leg portion due to its length.

18. A bulb-holding clip member for use in a decorative light mounting system for mounting a decorative light bulb and socket assembly, comprising:

a resilient bulb-holding clip member having a bottom portion with a downward facing opening of a cross sectional shape closely corresponding to the cross sectional shape of an outwardly projecting protuberance and sized and shaped to removably receive and grippingly engage the outwardly projecting protuberance by snap attachment, and a contiguous generally flat rectangular upper portion extending upwardly from said bottom portion; and a circular hole disposed near an outer edge of said upper portion of sufficient diameter to substantially encircle a neck portion of a decorative light bulb of a decorative light bulb and socket assembly with a narrow adjoining opening extending outwardly from said hole to the exterior of said outer edge; whereby a decorative light bulb and socket assembly is installed in said bulb-holding clip member as a single unit without disassembly of the bulb and socket by pressing the neck portion of the light bulb adjacent its socket downwardly and twisting the bulb assembly such that the neck portion passes through said narrow opening into said hole to become substantially encircled by said hole and said bulb and socket is supported in a generally horizontal position perpendicular said flat rectangular upper portion; and said bulb and socket assembly is removed from said bulb-holding clip member as a single unit by pulling the bulb and socket assembly upwardly and twisting it such that the neck portion of the bulb passes outwardly through said narrow opening.

19. A base member for use in a decorative light mounting system for mounting a decorative light bulb and socket assembly, comprising:

a resilient generally U-shaped base member having an outwardly projecting protuberance and a pair of contiguous opposed facing leg portions extending from said protuberance;

said opposed facing leg portions sized and shaped to selectively receive and grippingly engage either of a roofing shingle and the upper outer surface of a rain gutter, with said protuberance facing outwardly therefrom; and said protuberance sized and shaped to receive and engage a mating surface of a resilient bulb-holding clip by snap attachment.

* * * * *